US009714124B2

(12) United States Patent
Johnson

(10) Patent No.: US 9,714,124 B2
(45) Date of Patent: Jul. 25, 2017

(54) CAP ASSEMBLY FOR SLIDER VALVE FOR ASEPTIC PACKAGING

(71) Applicant: Liqui-Box Corporation, Richmond, VA (US)

(72) Inventor: James W. Johnson, Delaware, OH (US)

(73) Assignee: Liqui-Box Corporation, Richmond, VA (US)

( * ) Notice: Subject to any disclaimer, the term of this patent is extended or adjusted under 35 U.S.C. 154(b) by 0 days.

(21) Appl. No.: 15/165,304

(22) Filed: May 26, 2016

(65) Prior Publication Data

US 2016/0264319 A1 Sep. 15, 2016

Related U.S. Application Data

(62) Division of application No. 14/317,474, filed on Jun. 27, 2014, now Pat. No. 9,434,516.

(60) Provisional application No. 61/841,144, filed on Jun. 28, 2013.

(51) Int. Cl.

| | |
|---|---|
| ***B67D 3/00*** | (2006.01) |
| ***B65D 47/28*** | (2006.01) |
| ***B67D 3/04*** | (2006.01) |
| ***B67D 7/02*** | (2010.01) |

(52) U.S. Cl.

CPC ..... *B65D 47/283* (2013.01); *B67D 3/045* (2013.01); *B67D 7/0294* (2013.01)

(58) Field of Classification Search

CPC ..... B65D 47/243; B65D 47/4247; B65D 47/283; B65D 75/5877; B67D 3/045; B67D 7/0294; B67B 7/28

See application file for complete search history.

(56) References Cited

U.S. PATENT DOCUMENTS

| | | | | |
|---|---|---|---|---|
| 30,920 | A * | 12/1860 | Hiney | 220/278 |
| 2,565,954 | A * | 8/1951 | Dey | B65D 83/48 215/12.2 |
| 2,992,761 | A * | 7/1961 | Sommers, Sr. | E02D 7/24 222/479 |

(Continued)

FOREIGN PATENT DOCUMENTS

| | | | |
|---|---|---|---|
| CA | 1211385 | A | 9/1986 |
| CN | 102196967 | A | 9/2011 |

(Continued)

*Primary Examiner* — Patrick M Buechner
*Assistant Examiner* — Randall Gruby
(74) *Attorney, Agent, or Firm* — Baker & Hostetler LLP

(57) ABSTRACT

The present invention provides a slider valve assembly for connection to a spout of an aseptically-packaged flexible container for filling and dispensing flowable material. The slider valve assembly comprises a cap member, a valve member, and an outlet member. The cap member has a central opening and is adapted to be secured to the spout of the container. The valve member defines one or more side openings in communication with a central bore, is slidable within the central opening of the cap member and is lockable into a closed or open position. The outlet member is detachably engaged to the valve member and is used for actuating the valve member. The outlet member also defines a hollow interior portion which is in communication with the central bore of the valve member.

6 Claims, 4 Drawing Sheets

(56) References Cited

U.S. PATENT DOCUMENTS 3,168,969 A * 2/1965 Krieps ..... B65D 47/242 222/520
3,173,579 A * 3/1965 Curie ..... B65D 47/283 222/105
3,245,587 A * 4/1966 Brown ..... B65D 47/283 222/182
3,595,445 A * 7/1971 Buford ..... B65D 47/2025 222/213
4,253,588 A * 3/1981 Lester ..... B65D 47/247 215/270
4,325,496 A * 4/1982 Malpas ..... B65D 75/5877 222/83
4,353,488 A * 10/1982 Schneiter ..... B67D 3/045 222/501
4,375,864 A * 3/1983 Savage ..... B65D 77/067 141/349
4,380,310 A * 4/1983 Schneiter ..... B67D 3/045 222/501
4,421,146 A * 12/1983 Bond ..... B65D 77/06 141/349
4,445,551 A 5/1984 Bond et al.
4,742,851 A * 5/1988 Lundblade ..... B67D 3/045 137/614.12
5,031,662 A * 7/1991 Roethel ..... F16L 29/04 137/614.03
5,095,962 A 3/1992 Lloyd-Davies
5,217,433 A * 6/1993 Bunin ..... A61J 1/2093 206/221
5,372,267 A 12/1994 Hofmann
6,213,351 B1 * 4/2001 Stoneberg ..... B65D 47/248 215/315
6,257,463 B1 * 7/2001 De Polo ..... B65D 47/243 222/525
6,595,391 B1 * 7/2003 Anderson ..... B65B 55/022 222/105
6,637,725 B2 * 10/2003 Davis ..... B67D 1/0835 137/269
6,971,548 B2 * 12/2005 Smith ..... B67D 3/0019 222/83
7,448,418 B1 * 11/2008 Tuyls ..... F16L 21/08 141/114
7,628,299 B2 * 12/2009 Johnson ..... B65D 77/065 141/346
7,661,560 B2 * 2/2010 Murray ..... B65D 47/147 215/311
7,703,642 B2 * 4/2010 Scott ..... B65D 47/127 215/254
7,980,424 B2 * 7/2011 Johnson ..... B65D 75/5877 222/105
8,196,621 B2 * 6/2012 Johnson ..... B67D 1/0082 141/372
8,397,958 B2 * 3/2013 Smith ..... B65D 47/2031 222/105
8,485,353 B2 * 7/2013 Lee ..... B65D 47/243 206/219
8,578,979 B2 11/2013 Johnson
2004/0256424 A1 * 12/2004 Johnson ..... B65D 77/067 222/518
2006/0249476 A1 11/2006 Albers et al.
2007/0181578 A1 * 8/2007 Johnson ..... B65D 41/0471 220/258.3
2007/0205216 A1 * 9/2007 Smith ..... B65D 77/067 222/81
2012/0305519 A1 * 12/2012 Lee ..... B65D 47/2006 215/316
2016/0009533 A1 * 1/2016 Clusserath ..... B67C 3/002 141/91

FOREIGN PATENT DOCUMENTS

EP 1748028 A1 1/2007
FR 2303730 A1 10/1976
JP 2000-025802 1/2000
JP 2000025802 A * 1/2000
JP 2012-246043 12/2012
JP 2013-028391 2/2013
WO WO 83/01605 A1 5/1983

* cited by examiner

CAP ASSEMBLY FOR SLIDER VALVE FOR ASEPTIC PACKAGING

CROSS REFERENCE TO RELATED APPLICATIONS

This application is a divisional application of U.S. patent application Ser. No. 14/317,474, filed Jun. 27, 2014, which claims the benefit of U.S. Provisional Application No. 61/841,144, filed Jun. 28, 2013, of which are incorporated by reference herein in their entirety.

TECHNICAL FIELD

This invention relates to a slider valve assembly which is useful for, e.g., filling and dispensing flexible containers, and particularly for aseptically-packaged flexible containers.

BACKGROUND

Flexible, polymeric containers are well known for storing and dispensing wine, dairy products, enteral feeding solutions, fruit juices, tea and coffee concentrates, puddings, cheese sauces, and many other flowable materials, including those that must be filled aseptically. These generally include low acid materials. Flexible, polymeric containers typically have walls made of polymeric films with either a monolayer or multiple layer structure. The particular polymers constituting the container film layers vary depending on the type of material to be placed in the container. The film layers may also include an oxygen barrier material layer to prevent contact between such materials and oxygen or other gas sensitive contents. The walls of the containers may be metallized or coated with a metallic layer such as aluminum to prevent incursion of oxygen or other gases.

The flexible, polymeric containers have inlets and/or spouts for filling and dispensing the container contents. The containers are also often placed within a corrugated paper box. The spout extends through an opening in the box to dispense the contents. Such packaging systems are commonly referred to as "bag-in-box" systems. Bag-in-box packaging systems are often used in restaurants and convenience stores to facilitate service of liquid food products such as syrups, toppings, and condiments. These containers typically have a capacity of one to six gallons.

After the container is filled with a desired material, the spout is capped to seal the container and protect the contents from contamination. Depending on the type of contents, the container, spout, cap, and contents may be sterilized using steam, hydrogen peroxide (H2O2), radiation or other suitable sterilizing methods. In order to maximize the shelf life of the product, it is crucial that dispensing assemblies that are integrated within the spout of the container provide a hermetic seal for the entire life cycle of the container.

There are various systems that are in use or have been proposed for dispensing liquids from a disposable package consisting of a flexible collapsible bag in a corrugated paper box. Many of these dispensing systems are used in conjunction with quick-disconnect probes. Such systems are disclosed in U.S. Pat. Nos. 4,445,551, 5,095,962, and 4,421,146. In the foregoing systems, the valve members slide directly against the inside walls of the spout of the container.

Another type of dispensing system is disclosed in U.S. Pat. No. 5,031,662 wherein dispensing of the liquid using this adapter coupling is achieved by pressing a pair of fingers through the inlet opening against a resilient tube member.

This causes the resilient tube member to deflect away from the inlet opening and therefore allowing the contents of the container to be dispensed.

Because flexible containers are typically intended for one-time use and are discarded once the contents of such containers have been completely dispensed, there is a need for a dispensing assembly that is cost effective, easy to manufacture, quick to market, and preferably recyclable. It is desirable that the dispensing assembly for use with such packaging systems minimizes effort in accessing the container's contents while also minimizing contamination of the contents. Preferably, the dispensing assembly can also be easily operated without tools or the like. It is also desirable that the dispensing assembly can be adapted to standard and widely-used spout configurations and can be easily adapted to a flexible hose or tube. The dispensing assembly must be reliable, while dispensing of the contents is achieved without wasting the liquid through leakage, uncontrolled opening of the connection component and the like. Further, the dispensing assembly must be of sufficiently robust construction to withstand a number of opening and closing cycles.

SUMMARY

The present invention provides a slider valve assembly for connection to a spout of a flexible container comprising a cap member, a valve member, and an outlet member. The cap member has a central opening and is adapted to be secured to the spout of the container. The valve member defines one or more side openings in communication with a central bore, is slidable within the central opening of the cap member and is lockable into a closed or open position. The outlet member is detachably engaged to the valve member and is used for actuating the valve member. The outlet member also defines a hollow interior portion which is in communication with the central bore of the valve member.

Preferably, the outlet member has a handle portion for axially moving the outlet member relative to the cap member by depressing or pulling the handle portion. The axial movement causes sliding and/or locking of the valve member into a closed or open position. In the open position, the one or more side openings of the valve member are in communication with the container, thus permitting the contents of the container to be dispensed through the outlet member. Further, the outlet member can preferably be detachably secured to the cap member thereby locking the valve member into its open position. Preferably, the outlet member also has an exterior portion on which a flexible hose or tube may be frictionally engaged.

In another aspect, the present invention provides a flexible container having a slider valve assembly as described above.

In a yet another aspect, the present invention provides a slider valve assembly for a flexible container for flowable material adapted to be secured to a spout where the spout is secured to an opening in a container wall. The slider valve assembly comprises a cap member, a slider valve member, and an outlet member. The cap member defines a through central opening in communication with the contents of the container and is adapted to be secured to the spout of the container. The valve member is slidable within the central opening of the cap member and also lockable into a closed position wherein the container and contents are sealed, and into an open position wherein the flowable material may be dispensed. The outlet member is adapted to be secured to the valve member. The outlet member also defines a handle portion which provides a surface for moving and locking the sliding valve member into its open or closed position. The handle portion also defines one or more locking members adapted to engage the cap member and removably lock the valve member into the open position, thus permitting the flowable material to be dispensed from the container through the outlet member. The outlet member further defines an exterior portion on which a flexible tube or hose can be frictionally engaged.

In a further aspect, the present invention provides a cap assembly for connection to a spout of a flexible container. The cap assembly comprises a cap member, a valve member and a flexible barrier layer. The cap member is adapted to be secured to the spout of the container, defines a through central opening in communication with the contents of the container and defines a spout-receiving portion and a top portion. The valve member is slidably enclosed within the central opening of the cap member and lockable into a closed or open position. The flexible barrier layer is removably and hermetically bonded to the top portion of the cap member covering the central opening of the cap member thereby hermetically sealing the contents of the container and the valve member. Preferably, the flexible barrier comprises a tamper evident foil seal.

In another aspect, the present invention also provides a flexible container comprising the cap assembly described above.

Broadly, in accordance with yet another aspect of the invention, there is provided a method for producing a flexible container aseptically packaged with flowable material. The method comprises the steps of:

(a) providing a flexible container having a spout wherein the inside of the container is sterile;

(b) providing a cap member having a central opening in which the valve member is slidably enclosed, the cap member further defining a spout-receiving portion and a top portion;

(c) sterilizing the spout of the container;

(d) sterilizing the cap member and integrated slider valve member;

(e) filling the flexible container through the spout with flowable material;

(f) securing the cap member to the spout of the container by engaging the spout-receiving end of the cap member to the spout; and (g) removably bonding a flexible barrier layer to the top portion of the cap member for covering and hermetically sealing the valve member and the contents of the container therein.

In the above method, the flexible barrier preferably comprises a tamper evident foil seal. Further, the spout and the cap member with the integrated slider valve member are preferably sterilized using $H_2O_2$ vapor or steam.

Further, in accordance with yet another aspect of the invention, there is provided a method for dispensing the contents of a flexible container aseptically packaged with flowable material. The method comprises the steps of:

(a) providing an aseptically packaged flexible container containing flowable material and having a spout on which a cap assembly as described above has been installed, said valve member defining one or more side openings in communication with a central bore, said valve member being in the closed position wherein the side openings are sealed against the interior wall of the central opening of the cap member and no flow is permitted;

(b) providing an outlet member adapted to be secured to the valve member and also adapted to be removably engaged to the cap member, said outlet member further defining a hollow interior portion in communication with the central bore of the valve member and an outer portion on which a flexible tube or hose has been frictionally secured, said flexible tube or hose defining a fluid passage in communication with the hollow interior portion of the outlet member;

(c) positioning the container into the desired location for dispensing;

(d) removing the flexible barrier layer;

(e) securing the outlet member to the slider valve member; and (f) depressing the outlet member towards the spout such that the outlet member is removably engaged to the cap member, the valve member is slid and locked into its open position in which the side openings of the valve member become in communication with the inside of the container and contents are dispensed through the flexible hose or tube.

The present invention provides a slider valve assembly and method of producing an aseptic flexible container that permits easy assembly, installation, and dispensing while minimizing opportunity for contamination of the container contents. Additional features and advantages of the present invention are described in, and will be apparent from, the following Detailed Description and the figures.

DETAILED DESCRIPTION OF ILLUSTRATIVE EMBODIMENTS

Figure 1A:
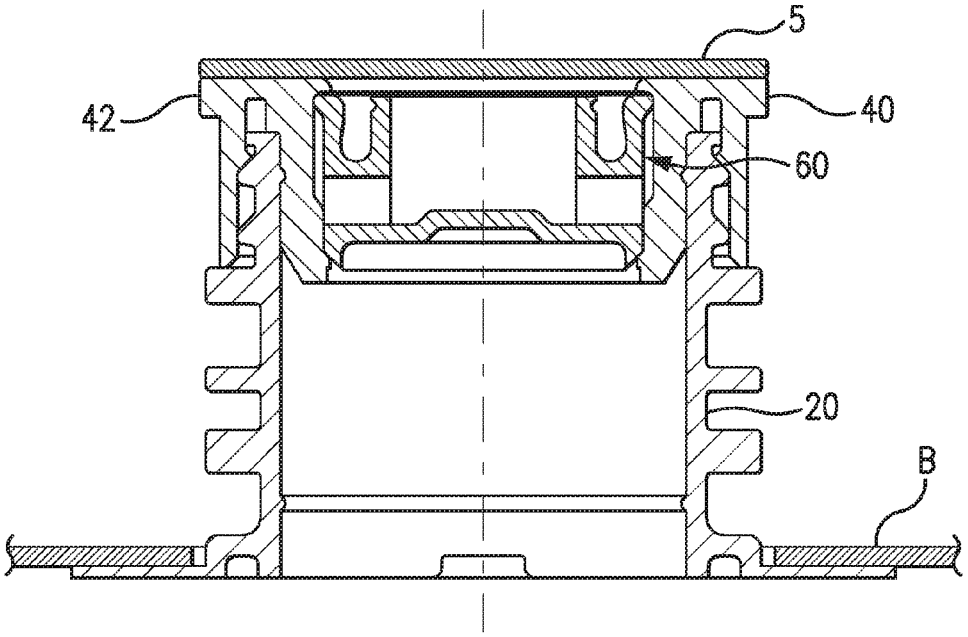
FIG. 1*a* shows a cross-sectional view of the cap member with integrated slider valve member secured to the spout of the container in the shipping/storage configuration where the flexible barrier layer installed.

Referring particularly to the drawings, the figures are for the purpose of illustrating one embodiment of the invention only and not for the purpose of limiting the same. FIGS. 1-4 illustrate a slider valve assembly 10 for aseptically-packaged flexible containers according to an exemplary embodiment of the invention generally comprising a cap member 40 adapted to the end portion 22 of a spout 20 of a flexible container B, a valve member 60 slidably fitting inside the cap member 40, and an outlet member 80 secured to the valve member 60.

Figure 1B:
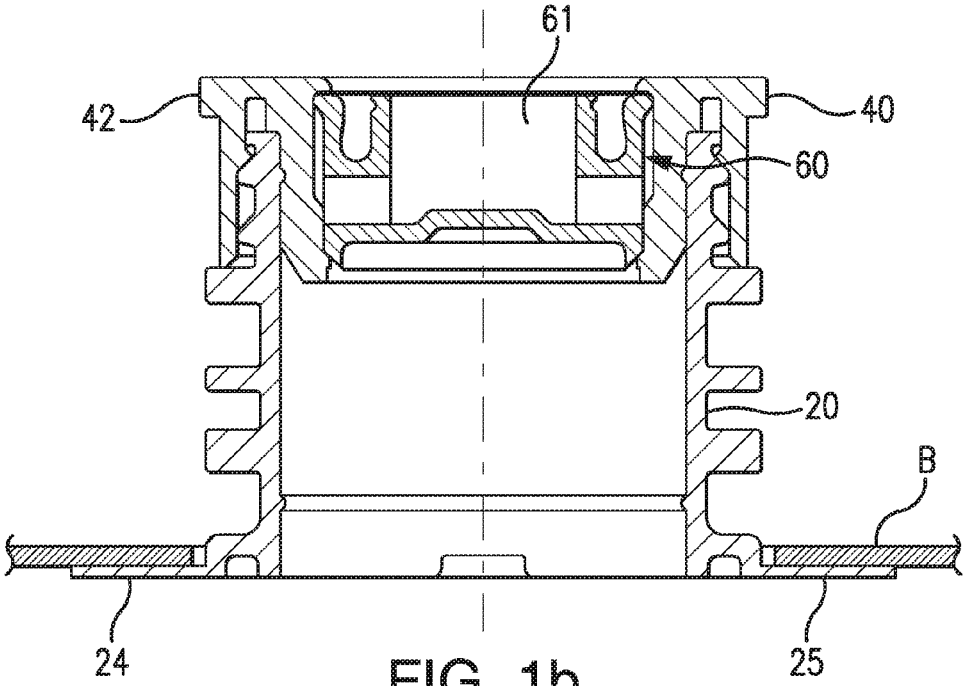
FIG. 1*b* shows a cross-sectional view of the cap member with integrated slider valve member secured to the spout of the container with the flexible barrier layer removed.

According to one embodiment and referring to FIGS. 1*a* and 1*b*, a flexible container B is provided with a spout 20. The configuration of the spout 20, shown in a preferred embodiment, is widely-used, commercially available, and is conventionally adapted to flexible containers such as bag-in-box systems. However, it is clear that the dispensing assembly of the present invention could also be modified and adapted to other types of spouts. The spout 20 comprises a generally cylindrical body that has a central opening 21 open at both ends. The central opening 21 of the spout 20 is in communication with the container. At its base, the spout 20 also has a relatively thin outwardly projecting flange 24 that is used to secure the spout 20 to an opening in the container wall B. The top surface 25 of the flange 24 is bonded to form a hermetically sealed connection with the inside surface 1 of the container wall B by means such as heat sealing or the like.

Filling of the flexible containers such as bag-in-box may be performed on any suitable aseptic filler known to those skilled in the art, and is typically performed using commercial packaging systems such as the Liqui-Box® Filler Model 2000 C1T-0-A (Liqui-Box Corp., Worthington, Ohio). Before filling and aseptic packaging, the container is supplied to the packaging system in a state where the inside of the container has been pre-sterilized using Cobalt gamma irradiation or any other suitable means of sterilization. The spout 20, cap member 40, and valve member 60 are then sterilized using Hydrogen Peroxide (H2O2) or any other suitable means. The container B is then filled with flowable material through the spout 20.

Once the container B is filled, the cap member 40 and valve member 60 are secured to the spout 20 of the container B as described below and shown in FIGS. 1*a* and 1*b*. In addition, a flexible barrier layer 5 is removably and hermetically bonded to the top portion 52 of the cap member 40 covering the central opening 41 of the cap member 40 thereby hermetically sealing the valve member 60 and the contents of the container B. In order to maximize the shelf life of the product, the hermetic seal must remain until the contents of the container are firstly dispensed.

The cap member 40 has a generally cylindrical shape but could be made to adapt other shapes of spouts such as oval or polygon-shaped. The cap member 40 has a through (open at both ends) central opening 41 and is adapted to be hermetically secured to the top end portion 22 of the spout 20 of the container B. During assembly of the cap member 40 on the spout 20, the cap member 40 and the spout 20 are firstly positioned such that the spout-receiving annular opening 44 receives the top portion 22 of the spout 20. An inward axial force is applied to the cap member 40 pressing the cap member 40 against the spout 20. As the cap member 40 is inserted onto the end portion 22 of the spout 20, the annular bead 42 extending radially inwardly inside the annular opening 44 forcefully and resiliently slides over and engages the outwardly projecting flange 23 of the spout 20. In addition, the inside surface 46 of the annular opening 44 of the cap member 40 simultaneously and forcefully slides against the annular bead 27 on the inside surface 28 of the spout 20. Once the annular bead 42 has slid completely passed the flange 23, surface 43 of the cap member 40 comes in contact with top surface 26 of the spout 20 and the extremity 47 of the exterior wall 45 of the cap member 40 also comes in contact with surface 29 of the outwardly projecting flange 30. Thus, the cap member 40 becomes secured to the spout 20 in a snap-fitting manner and a hermetic seal is created between the top portion 22 of the spout and the spout-receiving annular opening 44 of the cap member.

Figure 4:
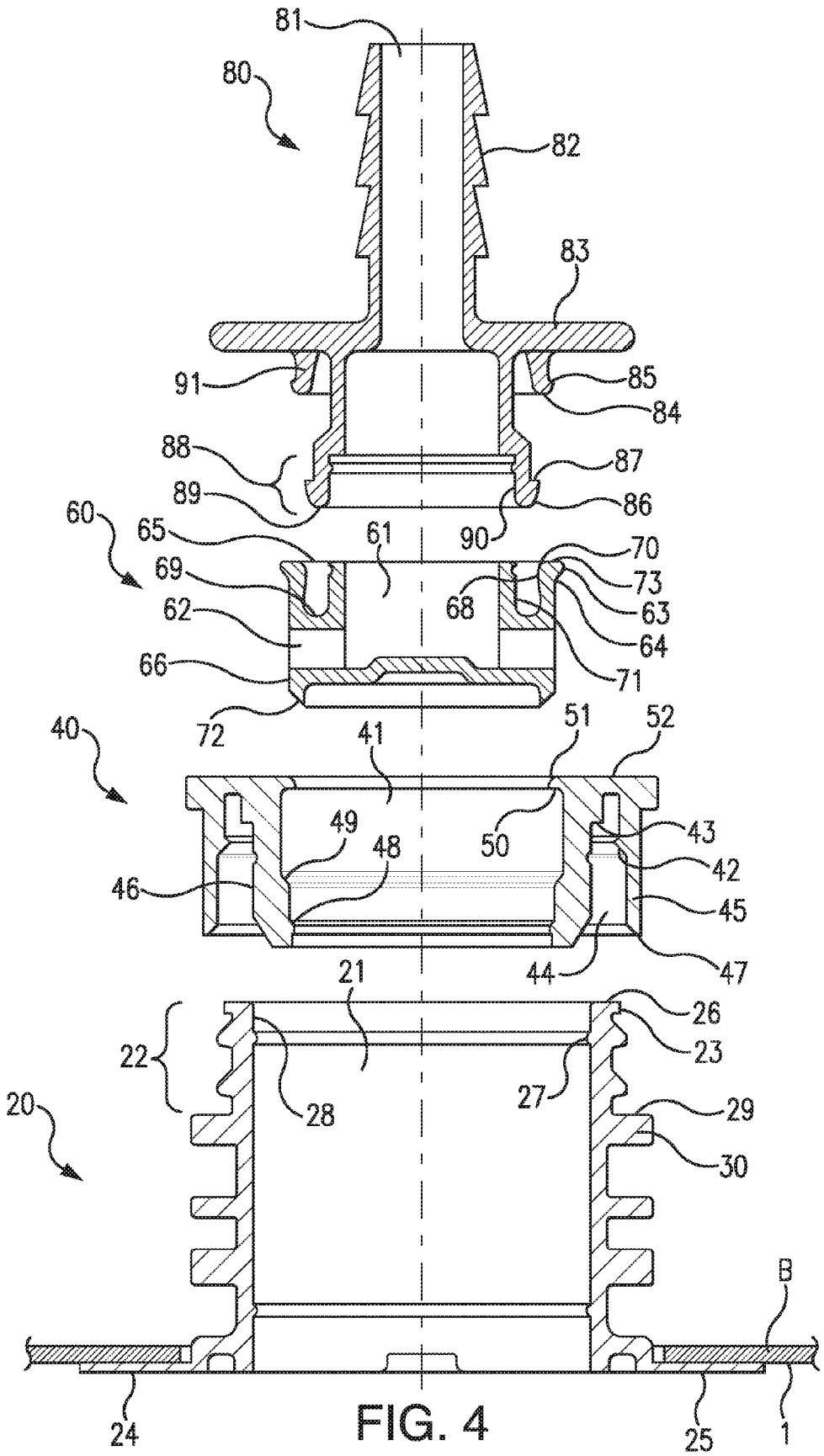
FIG. 4 shows cross sections of all the components of the slider valve assembly in an exploded view.

Referring to FIG. 4, the valve member 60 is a generally cylindrical shape body which includes one or more side openings 62 along a side wall 66 that are in communication with a central bore 61. The central bore 61 is only open from the top side of the valve member 60. The valve member 60 is positioned such that it is slidably fitting and lockable within the central opening 21 of the spout 20. The valve member 60 could be made to adapt other configurations of cap member 40 having oval or polygon-shaped central openings 41.

Referring to FIG. 4, the outlet member 80 is a generally cylindrical shape body having a hollow interior portion 81 that is open at both ends. The outlet member 80 also comprises a base portion 88 that is adapted to be secured to the valve member 60 and locking means adapted to engage with the cap member 40. In the subject embodiment, the outlet member 80 is illustrated as for connection with conventional hose line through the use of a standard ribbed exterior portion 82. Alternatively, other types of connections could be provided on the outlet member 80. In an alternate embodiment, the outlet member 80 could also be connected to a manifold system having multiple outlets (not shown). The outlet member 80 further comprises a handle portion 83 and one or more locking lugs 84.

Before dispensing the flowable material from the container B, the flexible barrier layer 5 shown in FIG. 1*a* is first removed from the cap member 40. The outlet member 80 is then be secured to the valve member 60 as described below.

Figure 2:
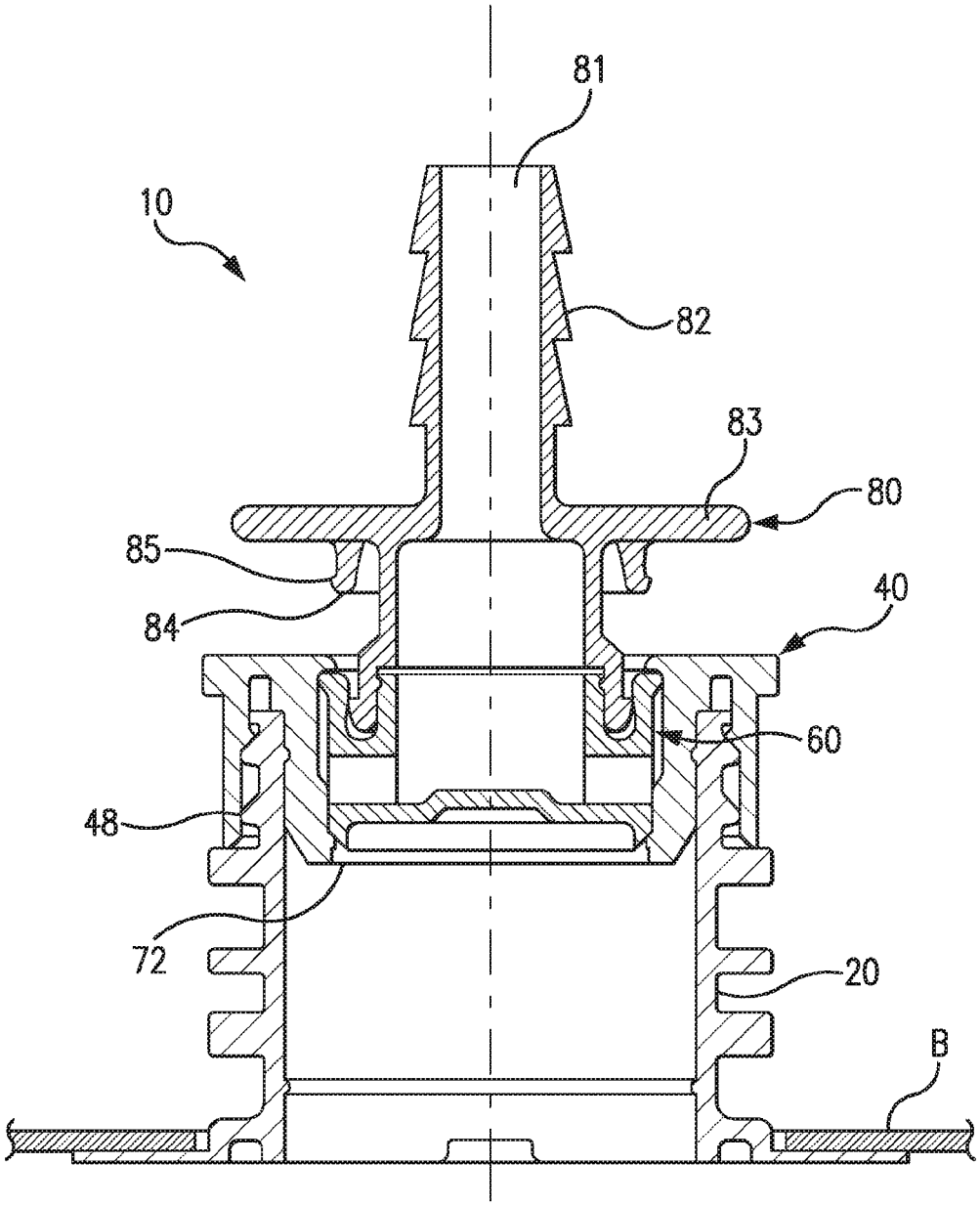
FIG. 2 shows a cross-sectional view of the slider valve assembly with the valve member in the closed position.

Referring to FIGS. 2 and 4, the outlet member 80 is secured to the valve member 60 by firstly positioning the outlet member 80 in relation to the valve member 60 whereby the annular opening 65 of the valve member 60 receives the base portion 88 of the outlet member 80. As the outlet member 80 is pressed against the valve member 60, the smooth contoured surface 86 defined in the base portion 88 resiliently slides over the axially inwardly protruding annular ridge 70 of the valve member 60. As the base portion 88 of the outlet member 80 is fully inserted into the annular opening 65 of the valve member 60, the bottom surface 89 of the outlet member comes in contact with the bottom surface 69 of the annular opening 65 of the valve member 60. At this point, the base portion 88 of the outlet member 80 locks into position in a snap-fitting manner and the radial shoulder surface 87 becomes engaged to the lower surface 68 of the annular ridge 70.

The dimensions of surface 90 in the base portion 88 of the outlet member 80 and surface 71 inside the annular opening 65 of the valve member 60 are designed such that a slight interference fit exists between these two mating surfaces. Therefore, as the base portion 88 of the outlet member 80 is inserted into annular opening 65 of the valve member 60, the mating surfaces 71 and 90 forcefully slide relative to each other and become resiliently pressed together. This creates a liquid impervious seal between the base portion 88 of the outlet member 80 and the annular opening 65 of the valve member 60.

With the outlet member 80 secured to the valve member 60, the handle portion 83 can then be used to axially move (push or pull) the outlet member 80 together with the valve member 60. This movement also moves the sliding valve member 60 and locks it into an open or a closed position within the central opening 41 of the cap member 40.

FIG. 2 shows the slider valve assembly 10 locked into the closed position. In the closed position, the bevelled surface 72 of the valve member 40 is in contact with the annular bead 48 protruding inwardly inside the central opening 41 of the cap member 40 thus creating a liquid impervious seal and isolating the one or more side openings 62 from the contents of the container B. The top surface 73 of the valve member 60 is also in contact with the radial shoulder surface 50 preventing the valve member 60 from further outward movement. The amount of force that is required to move the sliding valve member 60 inward from the closed position is significant enough that the slider valve assembly will not be accidentally opened by accidental nudging for example.

Figure 3:
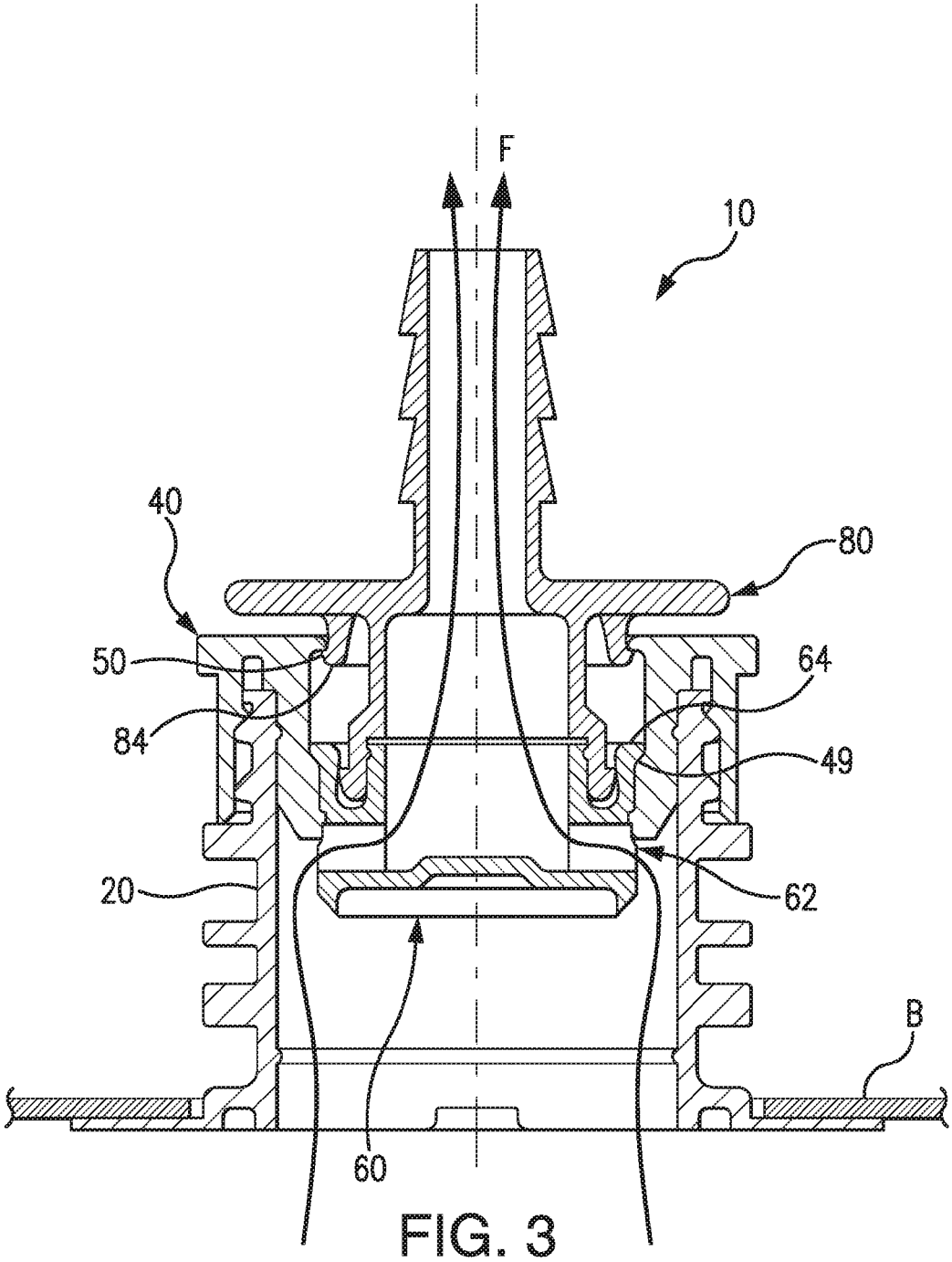
FIG. 3 shows a cross-sectional view of the slider valve assembly with the valve member in the open position.

FIG. 3 shows the slider valve dispensing assembly 10 with the valve member in the open position. Sliding the valve member into its open position is done by simply using the handle portion 83 to push the outlet member 80 axially inward towards the spout 20. The valve member 60 includes one or more side openings 62 along a side wall 66 that become exposed to the contents of the container when the valve member 60 is so slid in response to the outlet member 80 being pushed inwards.

As the outlet member 80 is pushed inwards, the bevelled surface 72 forcefully and resiliently slides over the annular bead 48 protruding axially inwardly inside the central opening 41 of the cap member 40 allowing the valve member 60 to also slide inward. The fully opened position is reached once the bottom surface 64 of the annular ridge 63 comes in contact with the bevelled surface 49. At this point, the one or more openings 62 become in communication with the inside of the container B and the contents may be dispensed through the outlet member 80 as shown by the arrows F on FIG. 3.

In the open position, the valve member 60 is locked into position by means of one or more locking lugs 84 on the outlet member 80 engaging the radial shoulder surface 50 of the cap member 40. Each locking lug of the subject embodiment comprises a longitudinally extending post or support 91 at the outer end of which is carried a protrusion 85 extending radially outwardly. When the outlet member 80 is pushed inwardly, it also pushes the valve member 60 into the open position and the protrusions 85 at the end of the locking lugs 84 engage onto the radial shoulder surface 50 of the cap member 40 in a snap-fitting manner thus creating a positive stop arrangement to hold the valve member 60 in the open position.

Upon pulling of the outlet member 80 outward away from the spout, the locking lugs 84 disengage from the cap member 40 and the sliding valve member 60 is also pulled axially back into a closed position within the cap member 40 wherein the side openings 62 are no longer in communication with the container B.

The amount of force that is required to slide and lock the valve member 40 back and forth between the open and closed position is significant enough that it will not be unlocked by merely nudging the dispensing assembly 10. However, the force required is also such that it can easily be operated manually.

Because these containers are typically intended for one-time use and are discarded once the contents of such containers have been completely dispensed, it is preferable that the dispensing assembly for use in such systems be easy to manufacture, cost effective, quick to market and recyclable. It is also important that the components are of sufficient quality and robustness to sustain a repeated number of closing and opening cycles while maintaining a hermetic seal during the entire life cycle of the container.

Accordingly, the construction of the components required to produce the slider valve dispensing assembly of the present invention is relatively simple and economical. All the components can be produced from commonly used and recyclable thermoplastic materials and formed using conventional plastic injection molding processes. For example, the cap member may preferably be made using medium density linear low density polyethylene (LLPE). The valve member may preferably be produced using a blend of 75% high density polyethylene (HDPE) and 25% LLPE. Finally, the outlet member may preferably be produced for example using HDPE or polypropylene (PP).

From the foregoing description, it can be seen that the present invention comprises an improved slider valve dispensing assembly. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

What is claimed:

1. A cap assembly for connection to a spout of a flexible container containing flowable material therein, the cap assembly consisting of:

(a) a cap member positioned on the spout of the container, wherein said cap member having an interior wall that defines a through central opening in communication with the contents of the container and further defines a spout receiving portion and a top portion, said interior wall having an annular bead and said cap member having a radial shoulder;

(b) providing an outlet member positioned on the valve member, the outlet member having a handle with locking lugs and thereby being removably engaged to the cap member;

(c) a valve member having a central bore defining one or more side openings slidably enclosed within the central opening of the cap member and being lockable into a locked closed or open position; and (d) a flexible barrier layer removably and hermetically bonded to the top portion of the cap member covering the central opening of the cap member thereby hermetically sealing the flowable material of the container and the valve member.

2. The cap assembly of claim 1, wherein the flexible barrier layer is a tamper evident foil seal.

3. A flexible container comprising the cap assembly of claim 1.

4. A method for producing a flexible container aseptically packaged with flowable material consisting of the steps of:

(a) providing a flexible container having a spout wherein the inside of the container is sterile;

(b) providing a cap member positioned on the spout of the container and having a valve member having a central bore defining one or more side openings being movable to an open or closed position therein, said cap member having an interior wall that defines a through central opening in which the valve member is slidably enclosed, said cap member further defining a spout-receiving portion and a top portion;

(c) sterilizing the spout of the container;

(d) sterilizing the cap member and valve member;

(e) filling the flexible container through the spout with flowable material;

(f) securing the cap member to the spout of the container by engaging the spout receiving end of the cap member to the spout; and (g) removably bonding a flexible barrier layer to the top portion of the cap member for covering thereby hermetically sealing the valve member and the contents of the container therein.

5. The method of claim 4, wherein the flexible barrier layer is a tamper evident foil seal.

6. A method for dispensing the contents of a flexible container aseptically packaged with flowable material consisting of the steps of:

(a) providing an aseptically packaged flexible container containing flowable material and having a spout on which the cap assembly of claim 1 having a flexible barrier layer thereon has been installed, the central bore of the valve member defining an interior wall and a central opening and wherein the side openings are in communication within the cap, said valve member being in the closed position wherein the side openings are sealed against the interior wall of the central opening of the cap member and no flow is permitted from the container to the spout;

(b) the outlet member defining a hollow interior portion in communication with the central bore of the valve member and an outer portion on which a flexible tube or hose has been frictionally secured, said flexible tube or hose defining a fluid passage in communication with the hollow interior portion of the outlet member;

(c) positioning the container into a desired location for dispensing;

(d) removing the flexible barrier layer;

(e) securing the outlet member to the slider valve member; and (f) depressing the outlet member towards the spout thereby engaging the outlet member to the cap member, sliding the valve member and locking it into its open position in which the side openings of the valve member become in communication with the container and flowable material is dispensed through the flexible hose or tube.

* * * * *